US006499584B1

(12) United States Patent
Keim et al.

(10) Patent No.: US 6,499,584 B1
(45) Date of Patent: Dec. 31, 2002

(54) METHOD AND APPARATUS FOR HANDLING BULK BAGS

(75) Inventors: Wendy M. Keim, Bloomsburg, PA (US); John E. DelGigante, Flagtown, NJ (US)

(73) Assignee: Merck & Co., Inc., Rahway, NJ (US)

( * ) Notice: Subject to any disclaimer, the term of this patent is extended or adjusted under 35 U.S.C. 154(b) by 186 days.

(21) Appl. No.: 09/688,391

(22) Filed: Oct. 16, 2000

Related U.S. Application Data

(60) Provisional application No. 60/161,441, filed on Oct. 26, 1999.

(51) Int. Cl.[7] ..... B65G 47/24

(52) U.S. Cl. ..... 198/407; 53/436

(58) Field of Search ..... 198/406–408, 198/403; 141/78, 114; 53/436, 437

(56) References Cited

U.S. PATENT DOCUMENTS 4,907,686 A * 3/1990 Cotic ..... 198/403
6,094,888 A * 8/2000 Pazdernik et al. ..... 53/436
6,364,090 B1 * 4/2002 Wild et al. ..... 198/408

* cited by examiner

*Primary Examiner*—Joseph E. Valenza
(74) *Attorney, Agent, or Firm*—James M. Hunter, Jr.; Mark R. Daniel

(57) ABSTRACT

There is disclosed an apparatus and method for evenly dispersing the contents of powder filled bulk bags, in order to create a flat, even, horizontal bulk bag surface for efficient attachment to the suction head of a vacuum lift.

5 Claims, 3 Drawing Sheets

SIDE VIEW

DECLINE SLIDE

INCLINE POWER BELT CONVEYOR

METHOD AND APPARATUS FOR HANDLING BULK BAGS

This application claims benefit of Provisional Application Ser. No. 60/161,441 filed Oct. 26, 1999.

BACKGROUND OF THE INVENTION

The present invention relates generally to an apparatus and method for preparing bagged bulk materials for palletizing. In particular, the invention relates to an apparatus and method for evenly dispersing the contents of powder filled bulk bags, in order to create a flat, even, horizontal bulk bag surface for efficient attachment to the suction head of a vacuum lift. This results in decreased opportunities for operator injury. The flat shape of the bag also aids in pallet stability.

Bulk powder bags are typically filled on a vibrating table, which is integrated into an automated filling line. Filled bags are sealed and prepared for palletizing. Palletizing requires even dispersion of the powdered material so that the palletized bags form an even, stable structure. Bags in which the contents have not been adequately dispersed, or flattened, give rise to an unbalanced pallet. Unbalanced pallets can topple and lead to lost inventory and personal injury. Bags that have not been flattened before palletizing also pose the potential problem of not being amenable to being lifted by a vacuum lift. A vacuum lift is a powered lifting system requiring the formation of a temporary seal between the suction head of the system and the bag to be lifted. After a seal is formed, the bag is lifted by the system, thus eliminating operator strain and injury. The vacuum is broken when the bag has been moved to a desired location. When a vacuum lift cannot be used to move filled bags, it is necessary for an operator to manually move the filled bags, which can lead to back strain and repetitive motion injuries.

A variety of solutions have been proposed to solve the problem of creating even, flat, horizontal bag surfaces. These solutions include the use of vibrating tables and roller-type devices. There are, however, several drawbacks associated with these devices. For example, vibrating tables can be noisy and generate a significant degree of particulate matter, which can be harmful to machinery and people. Roller devices can require a large amount of space and can be costly. Moreover, roller devices and vibrating tables may not work effectively with all powders. Filling bags on a vibrating table helps to settle the product, but also tends to contribute to the compacting of the product in the bottom of the bag. Bottom heavy bags disturb the pallet layer alignment and can cause difficulties during subsequent packaging steps, such as pallet shrink-wrapping.

Accordingly, there is a need in the industry for an apparatus to evenly flatten filled bulk bags, thereby generating a more uniform shape. The apparatus must also be effective in creating a flat surface suitable for lifting by a vacuum lift. The apparatus must also be relatively inexpensive and able to be integrated with existing equipment. The bag flattening apparatus of the instant application meets all of the above needs.

Thus, a primary object of the instant invention is to provide a means of dispersing materials packaged in bulk bags and in so doing, ready them for palletizing. Another object of the instant invention is to provide a means for palletizing powder filled bulk bags, providing uniform layering, while at the same time, minimizing worker injuries.

SUMMARY OF THE INVENTION

There is disclosed an apparatus for flattening filled bulk bags comprising a declined slide unit, an upwardly inclined conveyor belt structure with power means driving the belt, and a transfer cup assembly, said assembly comprising a pneumatically-driven transfer cup.

As a filled bulk bag travels down the declined slide, the contents of the bag are evenly dispersed. The contents are further dispersed when the filled bag impacts the transfer cup at the bottom of the declined slide. The cup is actuated by an operator activated push button, which causes the bag in the cup to be flipped over onto the inclined conveyor belt. The vertical flipping serves to further disperse the contents of the filled bag. The conveyor travels in an upwardly inclined direction and raises the bag to a position suitable for attachment to a vacuum lift.

DETAILED DESCRIPTION OF THE INVENTION

There is disclosed an apparatus and method for flattening filled bulk bags. The apparatus comprises a declined slide unit, said slide unit having a smooth top surface, said top surface being oriented at an acute angle relative to the horizontal, said unit being optionally supported by a plurality of legs; a transfer cup assembly, said assembly located integrally within said declined slide unit, said assembly comprising a pneumatically-driven transfer cup and an arm affixed to said cup; and an upwardly inclined conveyor belt structure, said structure being located such that it abuts the lower end of the decline slide unit; said structure having a centrally disposed continuous belt and having power means for driving the belt and also being optionally supported by a plurality of legs.

Figure 1:
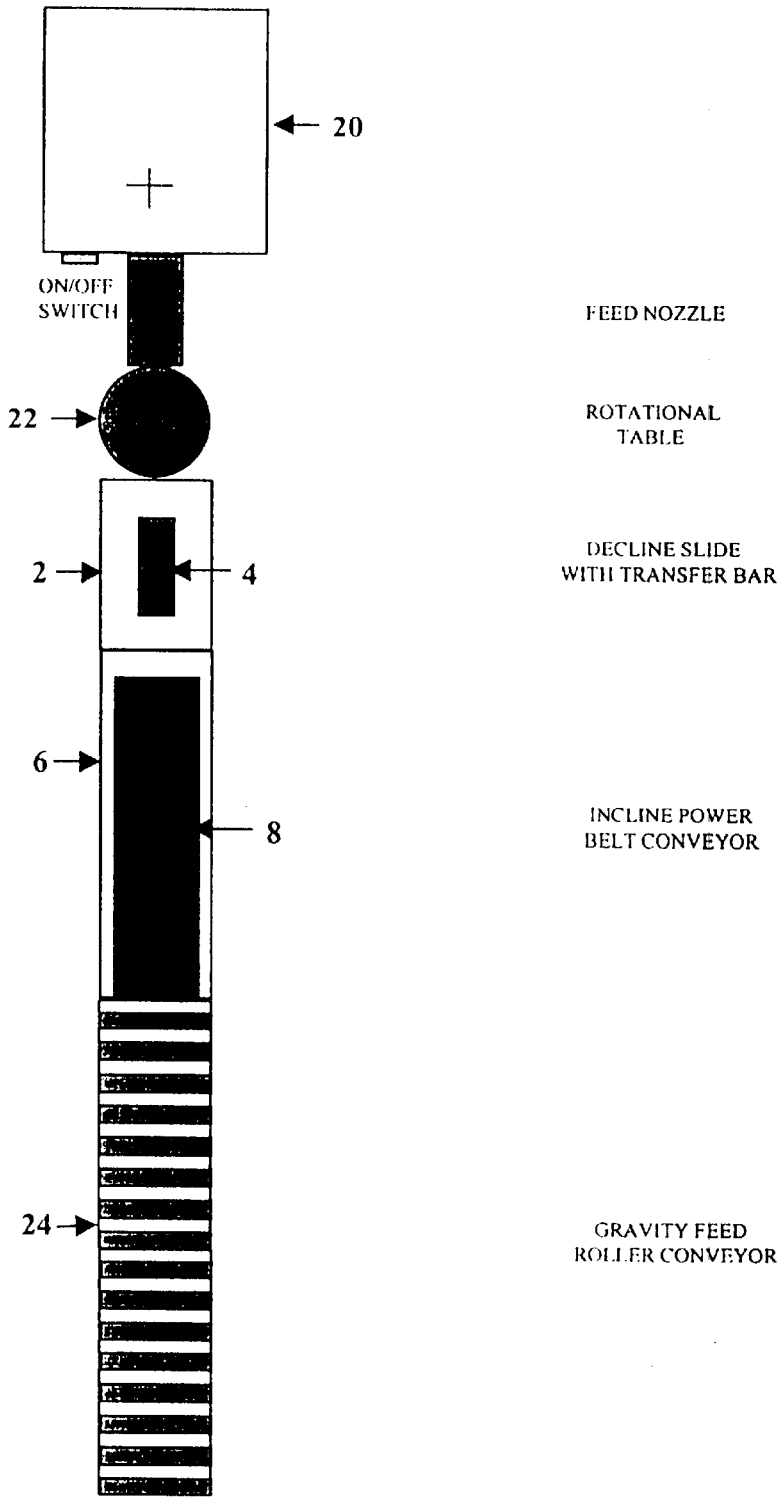
FIG. 1 shows a top view of the placement of the bag flattening apparatus inline with other packaging equipment.

FIG. 1 shows a top view of the apparatus inline with other packaging equipment in an industrial setting. As shown, bag filling machine 20 fills bulk bags with a powdered product. The filling process results in a filled bag that is bottom heavy as the powder settles in the bottom of the bag. The unbalanced bag is then placed on rotational table 22 where it is sealed and positioned for further handling. Rotational table 22 permits the bag to be oriented in a position desired by the operator, taking into account subsequent sealing and palletization operations. The sealed bag can then be toppled by the operator onto the declined slide unit 2. The declined slide unit is at an acute angle in order for the bag to freely slide downwards. The angle of the slide can be from about 20° to about 50°. Preferably, the angle of the slide is about 35°. Declined slide unit 2 may be stabilized by reinforcing structure, such as legs (not shown). The bag slides to the bottom of declined slide unit 2 and impacts the transfer cup which is integrally located within the declined slide unit. The inclined conveyor belt structure 6 abuts the bottom end of the declined slide unit 2. The angle of the inclined conveyor belt structure can be from about 15° to about 40°. Preferably, the angle of the incline is about 25°. As with declined slide unit 2, inclined conveyor belt structure 6 may be stabilized by reinforcing structures, such as legs (not shown). The combination of the bag travelling down the declined slide unit 2 and the impact with the transfer cup assembly 4 serves to disperse the powdered contents of the bag.

Following impact with the transfer cup assembly 4, the assembly 4 is triggered manually by means of an operator-controlled push button. Transfer cup assembly 4 is pneumatically controlled by means known in the art and travels through an arc passing the vertical position. The bag is carried by the transfer cup through this same arc causing it to flip over onto the inclined conveyor belt structure 6. High friction belt 8, integrally located on the inclined conveyor belt structure, carries the bag up the length of inclined conveyor belt structure 6, which further disperses the contents of the filled bag. The conveyor belt is powered by means known in the art such as a Reliance 1 HP motor. Upon reaching the top of the incline, the bag is transferred to gravity-controlled roller conveyor 24, which is at waist height. At no time is the operator required to lift the bag thus eliminating operator back strain. The flattened bag has a smooth, even, horizontal surface that facilitates the use of a vacuum lift suction head to grip and lift the bag onto a nearby pallet.

Figure 2:
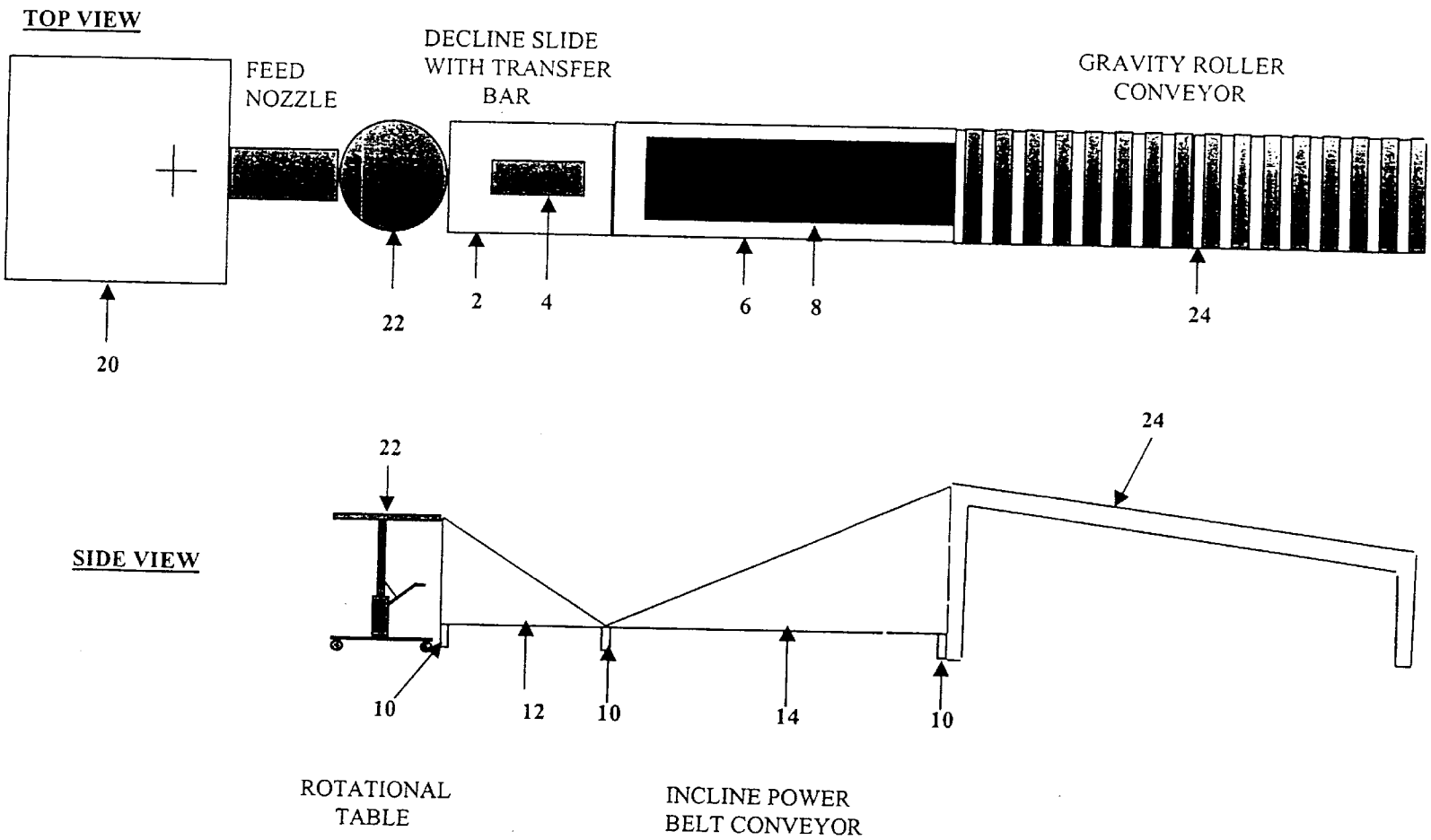
FIG. 2 shows top and side views of the bag flattening apparatus and the associated rotation table.

FIG. 2 shows top and side views of the apparatus and the associated rotation table and gravity roller conveyor. In the top view, declined slide unit 2 and transfer cup assembly 4 are shown. Inclined conveyor belt structure 6 and high friction belt 8 are also shown.

Declined slide unit side panel 12 and inclined conveyor belt structure side panel 14 are shown in the side view of the apparatus depicted in FIG. 2. Also shown are optional legs 10, which can be used to stabilize both declined slide unit 2 and inclined conveyor belt structure 6. The base of the legs may include wheels in order to make the unit portable. A place pin stabilizer which utilizes a pin attached to the unit and a receiving port in the floor to ensure unit alignment and stability may also be included.

Figure 3:
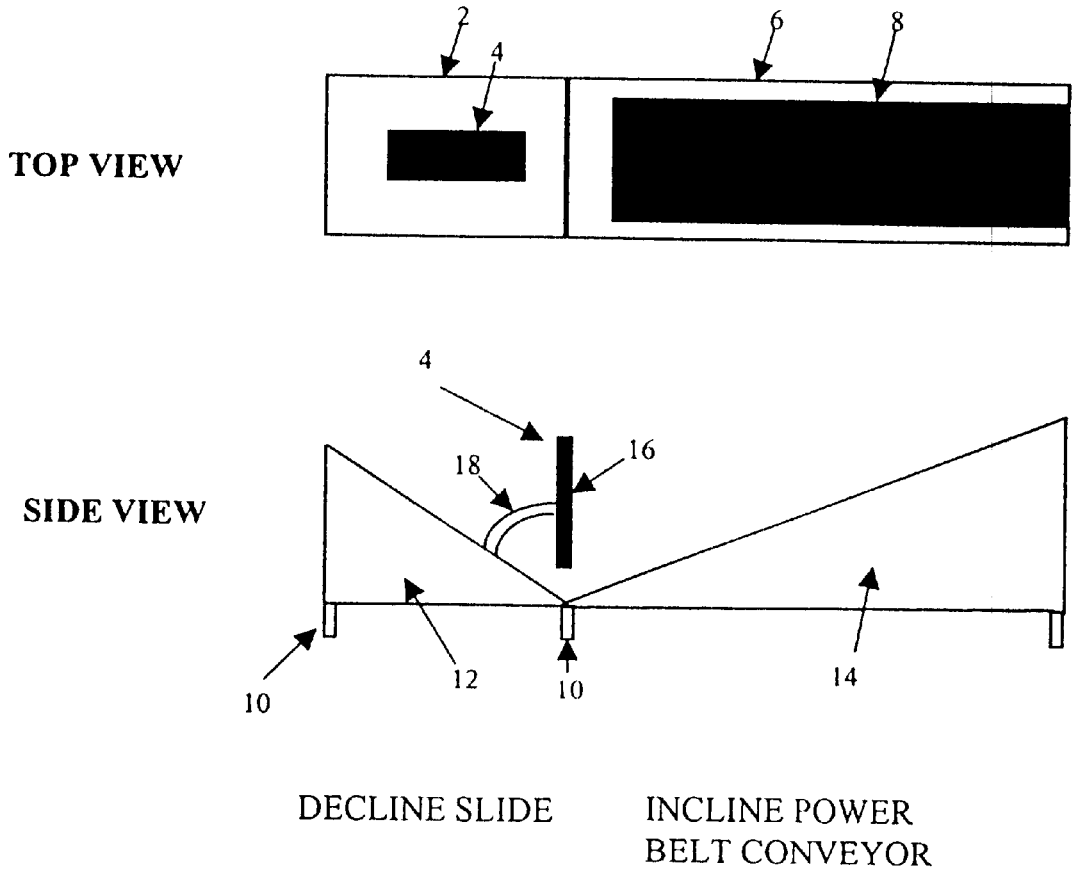
FIG. 3 shows top and side views of the bag flattening apparatus with the transfer cup assembly in its extended position.

FIG. 3 shows a side view of the bag flattening apparatus with the transfer bar assembly extended. Declined slide unit side panel 12 and inclined conveyor belt structure side panel 14 are again shown in FIG. 3 as are optional legs 10. Transfer cup assembly 4 is shown following activation by an operator. The cup contacts the filled bag after the bag has reached the bottom of the declined slide. Upon activation, the cup, which is controlled by a pneumatic arm, is extended. The cup, holding the filled bag, moves the bag through an arc. When the cup reaches a vertical position of about 90°, the filled bag falls onto the inclined conveyor belt structure 6 under the force of the bag's weight and gravity.

In construction, the declined slide, inclined slide and transfer cup are made of embossed stainless steel with rolled edges. The inclined conveyor belt is a vulcanized endless belt made of high friction pure gum rubber. It has a rough top to help grab the bag as it slides up the conveyor.

The principles, preferred embodiments and modes of operation of the present invention have been described in the foregoing specification. However, the invention which is intended to be protected is not to be construed as limited to the particular embodiments disclosed. The embodiments are to be construed as illustrative rather than restrictive. It is recognized, however, that departures may be made therefrom within the scope of the invention, and that obvious modifications may occur to a person skilled in the art, and that the metes and bounds of the invention are to be determined solely from the appended claims.

What is claimed is:

1. An apparatus for flattening filled bulk bags which comprises:

a) a declined slide unit, said slide unit having a smooth top surface, said top surface being oriented at an acute angle relative to the horizontal, said unit being optionally supported by a plurality of legs;

b) a transfer cup assembly, said assembly located integrally within said declined slide unit, said assembly comprising a pneumatically-driven transfer cup and an arm affixed to said cup; and c) an upwardly inclined conveyor belt structure, said structure being located such that it abuts the lower end of the decline slide unit; said structure having a centrally disposed continuous belt and having power means for driving the belt and being optionally supported by a plurality of legs.

2. The apparatus of claim 1 wherein the angle of the declined slide unit is about 20° to about 50°.

3. The apparatus of claim 2 wherein the angle of the declined slide unit is about 35°.

4. The apparatus of claim 1 wherein the angle of the inclined conveyor belt structure is about 15° to about 45°.

5. The apparatus of claim 4 wherein the angle of the inclined conveyor belt structure is about 25°.

* * * * *